United States Patent [19]

Daigle

[11] Patent Number: 4,708,307

[45] Date of Patent: Nov. 24, 1987

[54] STAND FOR HOLDING LEAF BAGS

[76] Inventor: Rosaire Daigle, 9715 Rex St., Hudson, Fla. 34669

[21] Appl. No.: 941,181

[22] Filed: Dec. 12, 1986

[51] Int. Cl.[4] ..... A63B 55/04

[52] U.S. Cl. ..... 248/97; 248/95

[58] Field of Search ..... 248/95, 96, 97, 98, 248/99, 100, 101, 158, DIG. 7, 230

[56] References Cited

U.S. PATENT DOCUMENTS

| | | | |
|---|---|---|---|
| 868,269 | 10/1907 | Hulbert | 248/100 |
| 1,329,985 | 2/1920 | McNaughton | 248/97 |
| 1,868,269 | 7/1932 | Beadle | 248/101 X |
| 3,893,649 | 7/1975 | Cornell et al. | 248/101 X |
| 4,376,520 | 3/1983 | Wetherington | 248/97 |
| 4,488,697 | 12/1984 | Garvey | 248/97 X |
| 4,513,923 | 4/1985 | Ulics | 248/230 X |

*Primary Examiner*—Ramon O. Ramirez
*Attorney, Agent, or Firm*—Stanley M. Miller

[57] ABSTRACT

A stand that holds a leaf bag in an upright configuration and maintains it in an open configuration. The stand includes a fixed diameter outer ring member and a variable diameter inner ring member that cooperate with one another to hold the leaf bag in an upright position when being filled with leaves and to hold the mouth of the bag open as well. A bag to be held is positioned so that its upper peripheral rim or mouth is encircled by the outer ring; the upper portion of the bag is then flared or folded radially outwardly so that it overlies the outer ring. The inner ring is then placed inside the mouth of the bag and the diameter of the inner ring is increased until a tight sandwiching relation is achieved between the outer and inner rings, with the upper portion of the bag positioned therebetween. The outer ring is supported by and extends horizontally from an upstanding base member that is maintained in its upstanding position by a horizontal bar at its lowermost end and a leg member that extends from the base member to the support surface in the same direction the outer ring extends from the base member.

3 Claims, 9 Drawing Figures

STAND FOR HOLDING LEAF BAGS

BACKGROUND OF THE INVENTION

1. Field of the invention

This invention relates to stands for holding leaf bags. More specifically, it relates to a leaf bag stand characterized by a pair of ring members that engage and hold open the mouth of a leaf bag when said ring members are positioned in registration with one another.

2. Description of the prior art

Leaf bags are hard to work with because they are formed of very flexible material; in the absence of a mechanical aid, the simple process of loading a leaf bag with leaves, grass and the like can require two people, one of whom merely holds the mouth of the bag open.

Inventors, recognizing major inefficiency in leaf and grass collecting methods, have turned their attention to the problem presented by the flexible bags.

The devices invented over the years vary widely in their respective constructions, but they have a common characteristic: they employ a fixed position ring member that serves to hold the mouth of the bag open.

Numerous means have been developed and patented for accomplishing the attachment of the mouth of the bag to the ring member.

For example, one commercially available device includes the ever-present fixed diameter ring member supported by three circumferentially and equidistantly spaced upstanding leg members. The leg members are secured to the ring member by wing nuts, and the holder is used by inserting the mouth of the bag within the circle defined by the ring member, flaring the mouth of the bag radially outwardly and then downwardly, and impaling the bag on the wing nuts.

The devices of the prior art perform their intended function, but some of the devices, such as the popular device just discussed, do damage to the bags. Once torn slightly, leaf bags tend to rip apart quite easily, so any attachment means that includes a deliberate puncturing of the bag to be held open is contraindicated.

Some of the earlier devices are also over-engineered, i.e., they are complex, inelegent structures that are not economical to manufacture and thus are not affordable by consumers.

There is a need for a simple yet elegant design for a leaf bag holder that holds leaf bags in their upright position and holds them open in the absence of bag tearing, but the needed device does not appear in the art.

SUMMARY OF THE INVENTION

The longstanding but heretofore unfulfilled need for a leaf bag stand of irreducible simplicity is now provided in the form of a stand characterized by two annular ring members that cooperate with one another to hold a leaf bag open.

A rigid, fixed diameter ring member is supported in a horizontal plane at a preselected height by a single base member.

The base member is maintained in its upright configuration by a horizontal stabilizing rod and a leg member attached to the base member at a point upwardly of the horizontal rod. The leg member projects outwardly from the base member in the same direction in which the outer ring member projects.

A variable diameter inner ring member may be formed into a small diameter or any number of larger diameters. The inner ring member is tubular in structure and bent into a circle so that its opposite ends are spaced apart from one another. A truncate tubular member having an outer diameter slightly smaller than the inner diameter of the inner ring member has a first end press fit into a first end of the inner ring member and a second end press fit into the opposite, second end of the inner ring member.

The press fit established between the opposite ends of the inner ring and the truncate tubular member is a sliding fit so that the opposite ends of the inner ring member can be spaced further and further apart, thus increasing the diameter of the inner ring, or closer and closer together, thus decreasing the diameter of said inner ring.

When the inner ring is positioned in surrounded or encircled relation to the outer ring and then expanded, the limit of its outer expansion is defined by the diameter of the outer ring. Thus, if the upper peripheral edge or rim of a leaf or trash bag is positioned intermediate the inner and outer ring members before the diameter of the inner ring member is increased by spreading its opposite ends apart as aforesaid, then in such even that portion of the bag caught therebetween will be tightly held in sandwiched relation therebetween.

This technique of holding the mouth of the bag open is highly desireable because it does not require that the bag be punctured.

It is also highly desireable because the operation can be accomplished by one person.

Moreover, the materials needed are inexpensive and due to the elegant nature of the structure, very few materials are needed to make the novel bag stand.

It is therefore understood that the primary object of this invention is to advance the state of the art in leaf bag holders.

Another object is to provide a leaf bag holder construction that is economical to manufacture.

A more specific object is to provide a construction that engages bags without tearing them.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
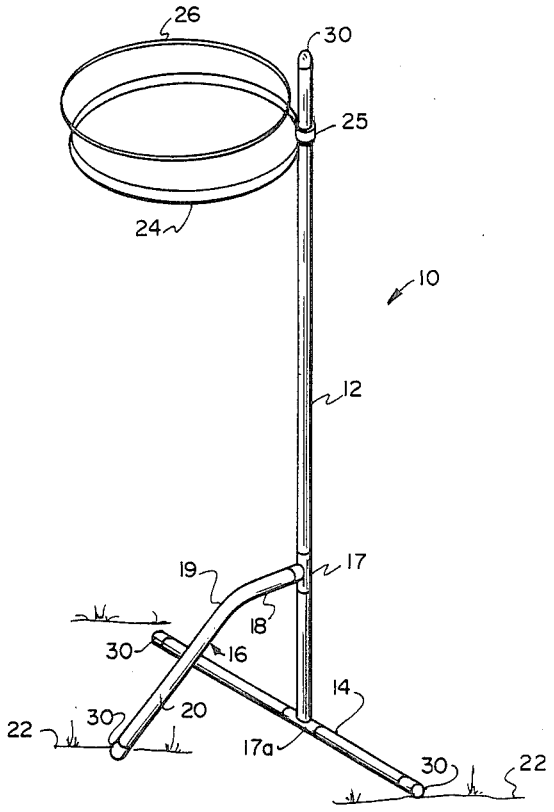
FIG. 1 is a partially exploded perspective view of the novel device.

Referring now to FIG. 1, it will there be seen that an illustrative embodiment of the invention is designated by the reference numeral 10 as a whole.

Leaf bag holder 10 includes an upstanding tubular member 12, hereinafter referred to as the base member 12, that is maintained in its vertical disposition by the cooperative effect of horizontal stabilizing rod 14 and leg member 16.

Base member 12, the stabilizer rod 14 and leg member 16 are preferably formed of PVC piping.

Leg 16 has a truncate horizontal portion 18 defined in part by the horizontal portion "T" connection 17 which joins leg 16 to base member 12 and in part defined by the horizontal portion of an elbow member 19. Leg 16 has an elongate downwardly inclined portion formed by the inclined portion of the elbow 19 and by PVC pipe 20 that extends from elbow member 19 to the ground or other support surface 22.

Figure 3:
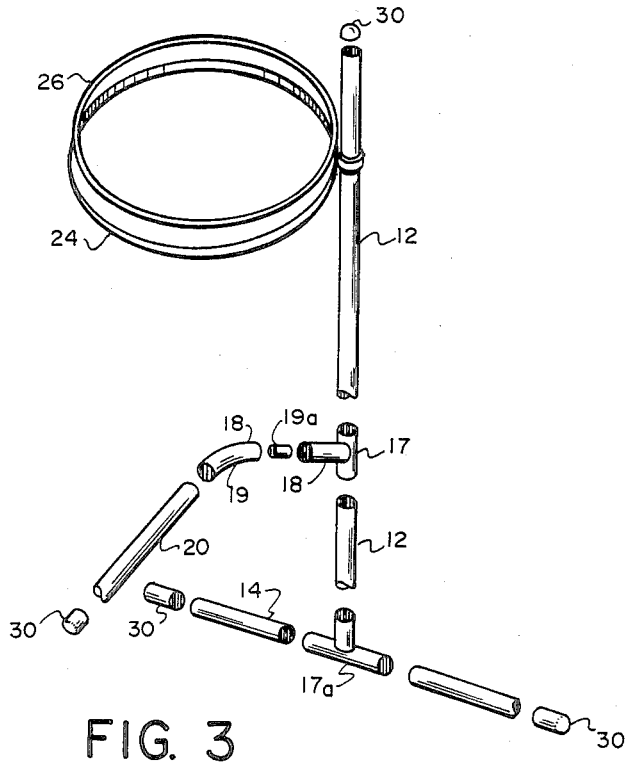
FIG. 3 is an exploded perspective view of all of the parts of the novel leaf bag stand.

Elbow member 19 is joined to "T" connection 17 through an interconnector means 19a as shown in FIG. 3.

Leg 16 is positioned in a plane orthogonal to the longitudinal axis of stabilizer rod 14.

Fixed diameter ring member 24 extends in cantilevered relation to upstanding base member 12 in the same direction as leg member 16 extends therefrom.

Figure 3A:
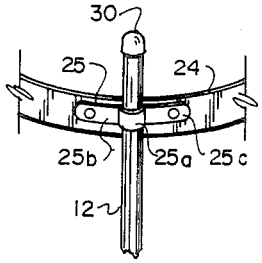
FIG. 3A is a detailed perspective view showing the means for clamping the outer ring member to the base member.
Figure 3B:
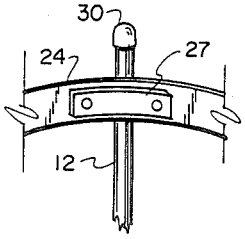
FIG. 3B is a detailed perspective view showing the clip means for joining the opposite ends of the outer ring member to form said outer ring member, which clip means is positioned on the opposite side of the outer ring member relative to the clamp member shown in FIG. 3A.
Figure 3C:
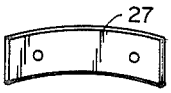
FIG. 3C is a detailed composite view showing the clamping means and the clip means shown in FIGS. 3A and 3B in perspective.
Figure 3C:
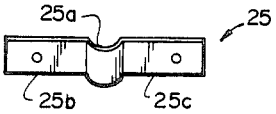

As shown in FIGS. 3A and 3C, a clamp member 25 having a semicircular medial portion **25*a* flanked by laterally extending apertured arms 25*b*, 25*c*, is employed to secure, by screw threaded engagement, outer ring 24 to base member 12 at a preselected height. Thus, the height of the outer ring member 24** could be adjusted if required.

The outer ring member 24 is preferably formed of PVC; its opposite ends are clipped together by flat clip member 27 as shown in FIGS. 3B and 3C. It should be undertstood that the same screws and nuts employed to secure outer ring 24 to base member 12 by means of clamp 25 are the same screw members employed to fasten clip member 27 in yoking relation to the opposite ends of outer ring 24.

Figure 2:
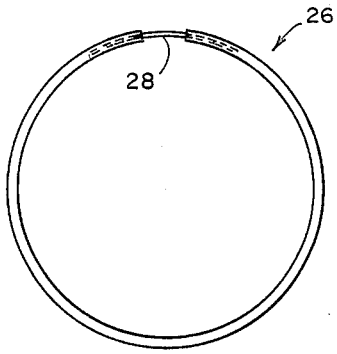
FIG. 2 is a plan view of the inner ring member of this invention.

FIG. 2 best depicts the inner ring member 26 and tubular adjustment member 28 slideably received within the opposite ends of said inner ring member 26.

Figure 2A:
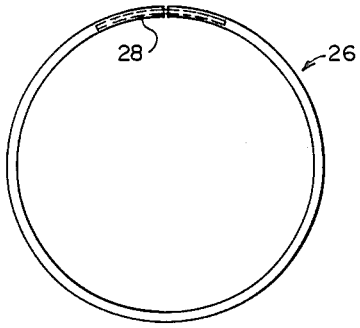
FIG. 2A is a plan view of the ring member of FIG. 2 in its smallest diameter configuration.
Figure 2B:
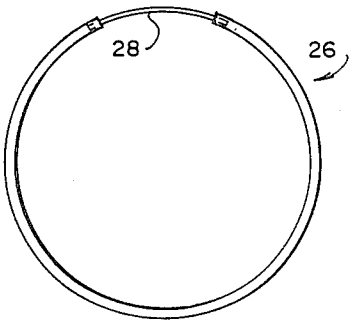
FIG. 2B is a plan view of the ring member of FIG. 2 in its largest diameter configuration.

FIG. 2A depicts the smallest diameter than can be achieved by inner ring member 26 and FIG. 2B depicts its maximum diameter, for a given length of adjustment member 28. The inner ring member may assume any number of positions intermediate the positions depicted in FIGS. 2A and 2B.

The change of positions is effected by simply spreading the opposite ends of the inner ring member 26 further and further apart or by converging them closer and closer together. The truncate adjustment member 28 has its opposite ends slideably received within the hollow inner ring member 26 and the necessary sliding engagement between the inner cylindrical sidewalls of the inner ring member and the outer cylindrical sidewalls of the truncate adjustment member is easily effected by simply grasping the opposite ends of the inner ring member 26 and adjusting the diameter of said member as desired.

As a practical matter, however, the extreme diameter positions of the inner ring 26 are never employed. Instead, the primary range of movement is centered about a central diameter.

For example, in a commercial embodiment of the device 10, the diameter of the outer ring member 24 is 15 inches. Thus, the diameter of the inner ring member 26 would never exceed said diameter.

The invention is used as follows: a leaf bag is placed inside outer ring member 24, i.e., outer ring member 24 is positioned in encircling relation to the mouth of the bag. The uppermost peripheral edge of the bag is then flared radially outwardly so that it overlies the outer ring.

The inner ring member 26 is then made small by converging its opposite ends toward one another, and said inner ring member is then positioned inside the bag in registration with the outer ring member 24.

The diameter of the inner ring member 26 is then increased in the above-described manner, until its diameter can no longer be increased due to the limiting factor of the fixed position outer ring member 24.

At this point, the upper peripheral edge of the bag will be firmly sandwiched between the inner and outer ring members.

If a loose interconnection is desired, the inner ring member 26 need not be opened to its maximum diameter; such a loose engagement of the bag's mouth may be appropriate at times.

However, if for any reason one were to desire lifting the stand 10 while the bag was still sandwiched between the cooperative ring members, then in such event a tight interconnection of the rings would be required.

FIG. 3 shows in detail the parts used to construct the novel stand 10. Those skilled in the art of machine design will be cognizant of other ways to build the inventive structure, and the invention of course is not limited to the precise details of construction that appear in FIG. 3.

The cap members that cover the upper end of base member 12, the opposite ends of stabilizer bar 14 and the ground-contacting end of leg member 16 are collectively designated 30.

The "T" connection that joins the base member 12 to stabilizer bar 14 is denoted **17*a*; as stated above, the "T" connection joining base member 12 and leg member 16 is denoted 17**.

Again, the specific clamps and other details of construction do not limit the invention.

Figure 4:
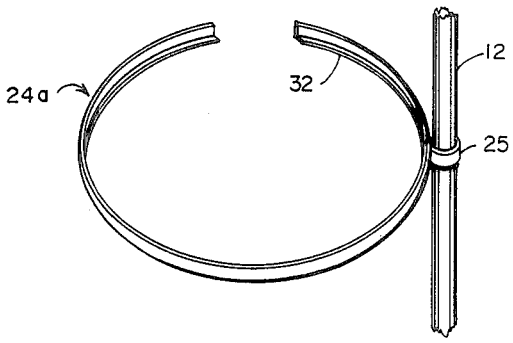
FIG. 4 is a partially broken away perspective view of an alternative embodiment of the outer ring member.

FIG. 4 depicts another embodiment of the outer ring member 24; said embodiment is therefor denoted **24*a*** as a whole.

It includes an annular, inwardly directed flange member 32.

Ring member **24*a* is shown broken apart just to better illustrate flange member 32**.

The purpose of flange member 32 is to provide a support surface for inner ring member 26 when said inner ring member is not engaging a bag, i.e., when the inventive device is not in use, flange member 32 supports the disengaged inner ring member 26.

In this manner, the inner ring member 26 may be stored with the device 10 and is not likely to get lost.

The leaf bag holder disclosed herein represents a significant advance in the art of leaf bag stands due to its elegant construction and its novel bag attachment means in the form of cooperating inner and outer ring members. Its use will provide increased efficiency in yard work settings, both residential and commercial. By cutting the man hours needed to accomplish the task of filling leaf bags, the invention contributes to the national economy by making extra time available to accomplish other productive tasks.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A device that holds a leaf bag in an upright configuration and that holds the mouth of the leaf bag in an open configuration at the same time, comprising:

an upstanding base member;

stabilizing means for maintaining said base member in its upstanding configuration;

a fixed diameter ring member extending in cantilevered relation to said base member;

a variable diameter inner ring member comprising a flexible, hollow tubular member of linear configuration formed into a circular configuration;

adjustment means for varying the diameter of said variable diameter ring member;

said adjustment means being a flexible tubular member of generally linear configuration the opposite ends of which are slideably received within opposite ends of said inner ring member to effect adjustment of the diameter of said inner ring member;

and a flexible bag member having its upper peripheral edge positioned in sandwiched relation to said inner and outer ring members.

2. A device that holds a leaf bag in an upright configuration and that holds the mouth of the leaf bag in an open configuration at the same time, comprising:

an upstanding base member;

stabilizing means for maintaining said base member in its upstanding configuration;

a fixed diameter ring member extending in cantilevered relation to said base member;

a variable diameter inner ring member;

adjustment means for varying the diameter of said variable diameter ring member;

a flexible bag member having its upper peripheral edge positioned in sandwiched relation to said inner and outer ring members;

said stabilizing means further comprising a horizontally disposed rod member positioned at the lowermost end of said base member and an angularly inclined leg member having its upper end connected to said base member and its lower end in abutting engagement to a support surface;

said fixed diameter ring member extending relative to said base member in the same direction as said leg member extends therefrom;

and said leg member extending from said base member in a plane orthogonal to the longitudinal axis of said horizontally disposed rod member.

3. A leaf bag holder, comprising:

a fixed diameter outer ring member;

a variable diameter inner ring member;

a base member having a cylindrical configuration;

said outer ring member disposed in cantilevered relation to said base member and formed on an elongate flat plate member bent into a circular configuration;

a clip member for yoking together opposite ends of said flat plate member so that the diameter of said outer ring member is fixed;

said clip member being provided in the form of a flat rectangular plate member that is suitably apertured to receive fastening members that secure its opposite ends to opposite ends of said outer ring member;

a clamp member to secure said outer ring member to said base member;

said clamp member having a semicircular medial portion to abuttingly engage said base member;

said clamp member having a pair of laterally extending flap members;

said flap members being suitably apertured to receive fastening members therethrough;

said clamp member positioned on an opposite side of said outer ring member in relation to said clip member;

said fastening members interconnecting said clip member and said clamp member through said fastening member apertures;

said inner ring member being an elongate tubular member bent into an annular configuration wherein its opposite ends are yoked together by a linear in configuration diameter adjustment member that has its opposite ends slideably inserted into the opposite ends of said inner ring member;

whereby the mouth of a bag to be held in an open configuration is inserted intermediate said inner and outer ring members and held in sandwiched relation therebetween.

* * * * *